US012291865B2

(12) United States Patent
Lahti

(10) Patent No.: US 12,291,865 B2
(45) Date of Patent: May 6, 2025

(54) WALL-BUILDING ELEMENT SYSTEM AND BUILDING ELEMENT FOR USE IN THE SYSTEM

(71) Applicant: Frank Cato Lahti, Vardö (NO)

(72) Inventor: Frank Cato Lahti, Vardö (NO)

( * ) Notice: Subject to any disclaimer, the term of this patent is extended or adjusted under 35 U.S.C. 154(b) by 674 days.

(21) Appl. No.: 17/618,350

(22) PCT Filed: Jun. 11, 2020

(86) PCT No.: PCT/NO2020/050150

§ 371 (c)(1),
(2) Date: Dec. 10, 2021

(87) PCT Pub. No.: WO2020/251366

PCT Pub. Date: Dec. 17, 2020

(65) Prior Publication Data

US 2022/0259856 A1 Aug. 18, 2022

(30) Foreign Application Priority Data

Jun. 12, 2019 (NO) ..... 20190719

(51) Int. Cl.
*E04C 2/296* (2006.01)
*E04B 1/61* (2006.01)
(Continued)

(52) U.S. Cl.
CPC ..... *E04C 2/296* (2013.01); *E04B 1/6145* (2013.01); *E04C 2/46* (2013.01); *E04C 2002/004* (2013.01)

(58) Field of Classification Search
CPC ..... E04C 2/296; E04C 2/46; E04C 2002/004; E04B 1/6145
(Continued)

(56) References Cited

U.S. PATENT DOCUMENTS 581,142 A * 4/1897 Schumacher ..... E04B 1/19 52/576
2,257,001 A * 9/1941 Davis ..... B28B 1/002 52/601
(Continued)

FOREIGN PATENT DOCUMENTS

CA 2986720 A1 * 7/2018 ..... E04C 2/292
CH 696270 A5 * 3/2007 ..... E04B 1/90
(Continued)

OTHER PUBLICATIONS

International Search Report and Written Opinion mailed Sep. 2, 2020 for International Patent Application No. PCT/NO2020/050150.

*Primary Examiner* — Jessica L Laux
*Assistant Examiner* — Joseph J. Sadlon
(74) *Attorney, Agent, or Firm* — Alix, Yale & Ristas, LLP

(57) ABSTRACT

Wall-building element system comprising sole elements, basic wall-building elements adapted to be assembled to a wall, and beams adapted to be fitted between each horizontal layer of the basic wall-building elements. The basic wall-building elements are prefabricated with a central, load bearing core member and form-stable layers of thermal insulation on both sides thereof. The core member and the thermal insulation layers are mutually adapted in a tongue-and-groove system while the beams are made in an "H"-profile corresponding thereto. The core member typically consists of a plate-shaped main body provided with laterally extending, vertically oriented ribs.

12 Claims, 6 Drawing Sheets

(51) Int. Cl.
*E04B 2/00* (2006.01)
*E04C 2/00* (2006.01)

(58) Field of Classification Search
USPC ..... 52/588.1
See application file for complete search history.

(56) References Cited

U.S. PATENT DOCUMENTS 2,644,552 A * 7/1953 MacDonald ..... E04B 1/541 52/580
3,000,144 A 9/1961 Kitson
3,113,401 A * 12/1963 Rose ..... E04B 1/541 52/793.11
3,365,851 A * 1/1968 Cushman ..... E04B 1/6183 52/582.2
3,367,076 A * 2/1968 O'Brien ..... E04C 2/296 52/592.4
3,369,065 A * 2/1968 Keith ..... B27D 1/06 425/173
3,553,921 A 1/1971 Breistein
3,583,118 A * 6/1971 Lowery ..... E04B 1/6175 52/309.5
3,777,430 A * 12/1973 Tischuk ..... E04C 2/292 52/309.9
3,922,413 A * 11/1975 Reineman ..... B32B 3/26 52/576
4,091,142 A * 5/1978 Elmore ..... B29C 44/386 264/45.3
4,116,415 A 9/1978 Ward
4,236,366 A * 12/1980 Rijnders ..... E04B 1/6133 52/592.1
4,360,553 A * 11/1982 Landheer ..... B32B 3/08 52/592.1
4,435,934 A * 3/1984 Kim ..... E04D 3/358 52/309.7
4,462,194 A * 7/1984 Wahner ..... B32B 15/20 411/510
4,501,101 A * 2/1985 Davis ..... E04B 1/941 52/404.3
4,641,468 A * 2/1987 Slater ..... E04C 2/205 52/309.7
4,642,960 A * 2/1987 Wallover, III ..... E04C 2/041 52/681
4,744,185 A * 5/1988 Lamberet ..... E04C 2/292 52/309.11
4,753,837 A * 6/1988 Hanusa ..... B29C 44/1228 428/317.9
4,918,895 A * 4/1990 Landheer ..... E04B 1/6125 52/592.6
4,936,078 A * 6/1990 Porter ..... E04B 1/6125 52/592.1
5,034,256 A * 7/1991 Santiso, III ..... B32B 7/12 428/116
5,095,674 A * 3/1992 Huettemann ..... E04B 5/04 52/794.1
5,270,108 A * 12/1993 Savoy ..... A01N 59/14 428/305.5
5,327,699 A * 7/1994 Khan ..... E04B 1/14 52/93.2
5,363,606 A * 11/1994 Esposito ..... E04B 7/22 52/95
5,381,638 A * 1/1995 Andersson ..... E04D 3/362 52/592.1
5,448,865 A * 9/1995 Palmersten ..... E04H 5/10 52/592.1
5,462,623 A * 10/1995 Day ..... B29C 44/5654 156/267
5,471,804 A * 12/1995 Winter, IV ..... E04B 1/6183 403/231
5,509,242 A * 4/1996 Rechsteiner ..... E04C 2/296 52/287.1
5,540,524 A * 7/1996 Gonsalves ..... E02D 27/01 52/576
5,589,243 A * 12/1996 Day ..... B29C 44/5654 428/56
5,613,338 A * 3/1997 Esposito ..... E04D 3/358 52/592.1
5,624,607 A * 4/1997 Kanai ..... E04B 1/948 252/605
5,624,622 A * 4/1997 Boyce ..... B29C 44/569 264/258
5,927,032 A 7/1999 Record
5,987,834 A 11/1999 Keith et al.
6,205,728 B1 * 3/2001 Sutelan ..... E04C 2/365 52/783.17
6,233,892 B1 * 5/2001 Tylman ..... E04D 3/366 52/794.1
6,358,599 B1 * 3/2002 Deibel ..... B32B 27/065 428/319.3
6,434,900 B1 8/2002 Masters
6,481,172 B1 * 11/2002 Porter ..... B32B 5/18 52/794.1
6,834,468 B1 * 12/2004 Kroie ..... E04C 2/292 52/794.1
7,291,234 B2 * 11/2007 Glorioso ..... B29C 44/326 264/46.5
7,810,293 B2 * 10/2010 Gibbar ..... E04C 2/288 52/432
7,984,594 B1 * 7/2011 Propst ..... B32B 37/18 52/309.7
8,196,365 B2 * 6/2012 Parshad ..... E04B 2/7448 52/239
8,499,514 B2 * 8/2013 Farrell, Jr. ..... E04B 2/847 52/791.1
8,534,028 B2 * 9/2013 Wojtusik ..... B29C 33/10 52/270
8,733,046 B2 * 5/2014 Naidoo ..... B32B 13/02 52/309.7
8,826,617 B2 * 9/2014 Endo ..... E04C 2/296 428/36.5
8,833,023 B2 * 9/2014 Masure ..... E04C 2/384 52/404.3
8,997,436 B2 * 4/2015 Spear ..... E04B 2/7401 52/800.1
9,010,067 B2 * 4/2015 Baker ..... E04F 15/04 52/391
9,027,300 B2 * 5/2015 Propst ..... B32B 13/04 52/309.12
9,151,053 B2 * 10/2015 Stephens, Jr. ..... E04B 1/7608
9,366,030 B2 * 6/2016 Spear ..... E04F 13/0894
9,551,147 B2 1/2017 Marstein
9,951,519 B2 * 4/2018 Neil ..... E04B 1/66
10,077,553 B2 * 9/2018 Neumayr ..... E04B 1/14
10,145,108 B2 * 12/2018 Chugh ..... E04C 2/296
10,316,515 B2 6/2019 Budinscak, Jr. et al.
10,570,617 B2 * 2/2020 Kolcun ..... E01F 8/007
10,815,660 B2 * 10/2020 Tremblay ..... E04C 2/284
11,472,154 B2 * 10/2022 Wolf ..... F16B 11/006
11,479,158 B2 * 10/2022 Nelson ..... B32B 27/065
12,098,547 B2 * 9/2024 VanHoose ..... B28B 19/0053
12,129,648 B2 * 10/2024 Espada ..... E04C 2/24
12,188,222 B2 * 1/2025 Morrow ..... E04B 1/12
2002/0043045 A1 * 4/2002 Marino Del Din ..... E04B 2/847 52/783.1
2004/0035068 A1 * 2/2004 Eliyahu ..... B32B 13/04 52/271
2005/0064145 A1 * 3/2005 Hoie ..... E04B 7/22 428/167
2009/0064617 A1 3/2009 Montoya et al.
2009/0205277 A1 8/2009 Gibson
2009/0282759 A1 11/2009 Porter
2010/0139197 A1 * 6/2010 Woodhall ..... B32B 15/08 52/404.1
2011/0047912 A1 3/2011 Armijo
2012/0216476 A1 * 8/2012 Naidoo ..... B32B 13/02 52/794.1
2014/0059961 A1 3/2014 Yin et al.
2014/0215947 A1 8/2014 Naidoo

(56) References Cited

U.S. PATENT DOCUMENTS

| | | | | |
|---|---|---|---|---|
| 2014/0223848 | A1* | 8/2014 | Binhussain | E04B 2/18 52/604 |
| 2015/0135623 | A1* | 5/2015 | Garrett | E04C 2/38 52/745.1 |
| 2015/0135634 | A1* | 5/2015 | Hoie | E04C 2/243 52/745.05 |
| 2020/0023550 | A1* | 1/2020 | Makhalin | B28B 11/00 |
| 2020/0048906 | A1* | 2/2020 | Honkala | E04C 2/12 |

FOREIGN PATENT DOCUMENTS

| | | | | | |
|---|---|---|---|---|---|
| CN | 101131029 | A | * | 2/2008 | E04F 13/00 |
| CN | 106088461 | A | * | 11/2016 | C04B 28/00 |
| CN | 110863604 | A | | 3/2020 | |
| DE | 202004020808 | U1 | | 2/2006 | |
| DE | 102014000070 | A1 | | 2/2015 | |
| DE | 102015120886 | A1 | * | 6/2017 | E04B 1/6133 |
| EP | 1637666 | A3 | * | 7/2009 | E04C 2/04 |
| EP | 2141303 | A2 | * | 1/2010 | E04C 2/296 |
| EP | 2348161 | A2 | | 7/2011 | |
| EP | 3115524 | A1 | * | 1/2017 | E04C 2/205 |
| FR | 2904015 | A1 | * | 1/2008 | B32B 7/02 |
| GB | 2294067 | A | | 4/1996 | |
| JP | 069224 | A | | 1/1994 | |
| JP | 3195057 | U | | 12/2014 | |
| KR | 20120018663 | A | | 3/2012 | |
| NL | 8304116 | A | | 7/1985 | |
| WO | WO-2004076764 | A1 | * | 9/2004 | E04B 1/14 |
| WO | WO-2006116823 | A1 | * | 11/2006 | B32B 27/065 |
| WO | WO-2015114147 | A1 | * | 8/2015 | E04C 2/22 |

* cited by examiner

WALL-BUILDING ELEMENT SYSTEM AND BUILDING ELEMENT FOR USE IN THE SYSTEM

BACKGROUND

According to a first aspect, the disclosed embodiments relate to a wall-building element system and to a basic wall-building element or module, which constitutes a key part of the wall-building element system.

In many situations there is a need to raise buildings quickly and in an inexpensive manner, that being for temporary use or for permanent use. Such situations may be related to refugees' camps, major disaster situations like earthquakes or tsunamis, but also situations of less urgency, such as improving building quality in poor regions.

On the other hand, plastic waste material has become a large and growing environmental problem on shore and off shore. An ideal situation would be to solve the first mentioned problems by using the waste material constituting the second mentioned problem as a raw material.

The disclosed embodiments find use for plastic waste material as a raw material in a wall-building element system that allows buildings of a decent and reliable standard to be assembled in a minimum of time.

Many modular building systems are known, primarily based on conventional materials and suitable as permanent buildings like apartment buildings or residential houses of high standard. On the other end of the scale, tents and modular building systems based on standard containers have been suggested.

US 2014/0059 961 A1 teaches thermally insulated composite panels comprising layers of non-combustible, cement based material and a core of insulating material.

US 2009/0205 277 A1 describes a panel system of five layers, with a centre plate layer, insulating layers on both sides of the centre layer and outer plate layers again to cover the exterior sides of the insulating layers.

WO 2004/076764 A1 teaches a wall or ceiling element comprising outer plate shaped layers of wood surrounding a layer of foamed polystyrene.

A more complex building block is described in EP 2966235 A1, comprising a centre insulating layer, plate layers and longitudinally extending reinforcement elements.

The disclosed embodiments deviate from the prior art building elements in problem approach as well as with regard to the technicalities.

SUMMARY

With the wall-building element system disclosed herein, temporary or permanent buildings may be raised quickly and at a low cost on any flat surface. The main component of the building system is a wall-building element comprising a load bearing central core, typically made of a rigid synthetic material, preferably recycle or waste plastic material or a composite product including such plastic material, plywood or the like. The wall-building element further comprises form-stable layers of thermally insulating materials preferably made of foamed recycled or waste plastic material. These elements are adapted to be combined with similar elements horizontally and vertically to thereby construct a wall. 'Between each horizontal layer of these wall-building elements specially adapted H-profiled beams or rails are arranged to transfer load in a safe and reliable manner in a vertical direction. These H-beams are specifically adapted to the top side surface and the bottom side surface of the wall-building elements to ensure that the vertical forces are correctly transferred from level to level of the core member of each wall-building element and to ensure that there is no overload of the comparatively weaker, though substantially rigid, thermal insulation layer of the wall-building elements.

A complete building will always comprise at least one outer door and typically, but not necessarily, a number of windows. Windows and doors may generally be adapted to a building raised in one of two alternative ways. One way is to cut out the required opening, typically using an electric sawing/cutting machine and to put in a door or a window, including frame, more or less of a standard type. The frame of a window assembled in a basic wall-building element in such a manner, could be provided with a lower beam, in wood, metal or synthetic material, having a profile corresponding to the lowermost side edge of a wall-building element, adapted to be mounted on top of a section of an H-beam. Similarly, the uppermost side edge of the window frame may have profile like the top side edge of a wall-building element, hence being adapted to the lowermost part of the H-beam being part of the present system. In such a case, the lower and the upper sides of the cut out opening may be provided with an H-beam before assembly. This allows the window/frame, once assembled in a wall, to become part of the load bearing structure of the wall, if the window frame has an adequate load bearing capacity.

Another way of adapting doors and windows, is to include production elements with the same dimensions as any other basic wall-building elements, in which a door frame or a widow frame is included already as a prefabricated element, ensuring that the end user does neither need to perform any cutting nor any kind of adaptation during assembly of a building. On the other hand, this alternative requires a higher number of alternative building elements, in particular if the end user shall be allowed to choose between different window and/or door sizes. While assembly of doors and windows are required operations during assembly of a building, the manner in which it is made is not discussed in further detail herein.

The form-stable layer of insulation material will typically exhibit properties including UV resistance and moisture resistance, and may be supplied with a polymer coating of UV resistant and/or moisture resistant material at the exterior side of the basic wall-building element to ensure long lasting properties with regard to resistance against moisture and sunlight.

While the specific materials for the load bearing core member and for the thermal insulation layers may vary, typically both are comprised by recycle plastic materials. The material for the thermal insulation layers is foamed to a desired density without jeopardizing its form stability. In commercial buildings it is estimated that about 60% of the materials used will be recycle plastic materials.

The thermally insulating material is typically rich in polyethylene (PE). Other plastic materials may also be used but the ones mentioned are preferred also due to their availability in vast amounts. The thermal insulation layers are foamed to a high degree and may have a density about 28 kg/m$^3$ (less than 3% of the density of water). The expanded—or foamed—polyethylene of such a density still is form-stable and well functioning for the purpose of the disclosed embodiments.

Materials of polyvinyl chloride (PVC) may also be useful in relation to the embodiments, such as for rooftops and the like.

The load bearing core member may typically be comprised by a material selected from the group consisting of honeycomb polymer structure, preferably including recycled polymer material, composite materials, plywood, or a combination thereof and having a density typically around 80-130 kg/m$^3$, i.e. still a density in the range 8-13% of the density of water. The load bearing capacity in terms of compressive modulus as defined by ASTM C365-57 has been found to be about 20 MPa (about 200 atm). The polymers for the load bearing core member typically comprises at least one of polyethylene (PE), polypropylene (PP) and polyethylene terephthalate (PET), the latter typically used just as a coating material.

With a convenient element thickness, the specific weight of the basic wall-building element according to the disclosure typically is in the range 25-30 kg/m$^2$. While it might be assumed that such a light construction would be vulnerable for damage in strong winds, tests have shown that buildings raised in accordance with the disclosure are surprisingly stable. This is believed to be due to the way in which all the elements engage with other elements. In addition, the buildings are stabilized by the roof structure that closes the building and binds the walls together, preventing winds from getting inside. The roof structure is, however, is not described in any detail here. Any conventional roof structure may be used for providing a roof for the disclosed wall-building elements.

The square dimensions of the basic wall-building elements may vary within wide limits dependent upon type of building, location, available means for transportation and assembly etc. For instance, in situations where cranes or the like are not available for lifting and positioning the elements to their intended positions and orientations, the elements should preferably not be larger than allowing manual handling by two people. One element could have a height corresponding to a floor, e.g. 2.4 meters. If such an element has a width of 1.2 meter, its square dimension is 2.9 meters and its weight near 75 kg (assuming a specific weight of 25 kg/m$^2$. Two people would quite easily be able to raise and assemble elements of such a weight.

DETAILED DESCRIPTION

Figure 1A:
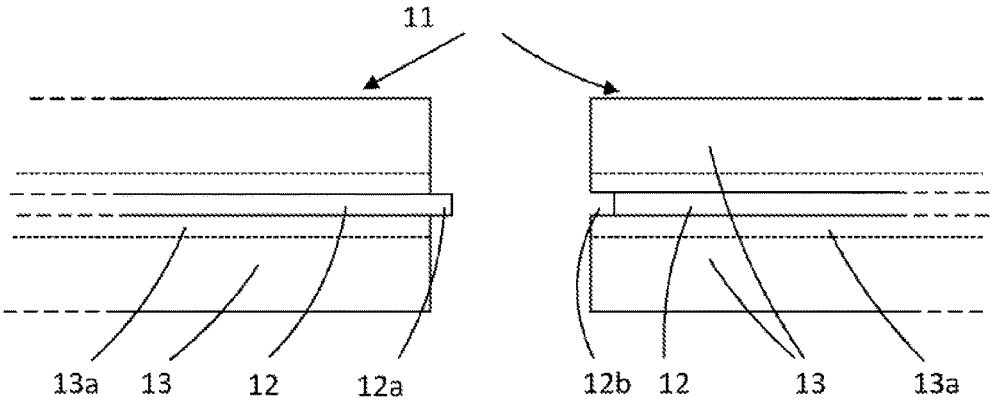
FIG. 1A is a schematic top view of two basic wall-building elements according to an embodiment, in a state not yet assembled.

FIG. 1A shows schematically end sections of two wall-building elements 11 according to a disclosed embodiment, the right-most part of one element and the left-most part of an adjacent similar element. Each element has a core member 12, which is the load-carrying element, and on both sides thereof, a thermal insulation layer 13. The core member is made in a material with a compressive strength sufficient to take up all vertical forces applied when the elements are assembled to complete walls and a roof being put on top of the walls. The thermal insulation layer 13 is preferably made from recycled plastic materials, which are subsequently foamed to a density beyond a minimum density level. The thermal insulation layer exhibits integrity in the sense that it is rigid and dimensionally stable.

At one short side of the wall-building element, shown as the right part of the left-most element in FIG. 1A, the core members protrudes from the thermal insulation layer, thereby forming a tongue 12*a*. At the other side of the wall-building element, shown as the left part of the right-most element in FIG. 1, the core member 12 is recessed as compared to the thermal insulation layer 13, thereby forming a groove 12*b* of a width adapted to the width of the load bearing core member 12.

Figure 1B:
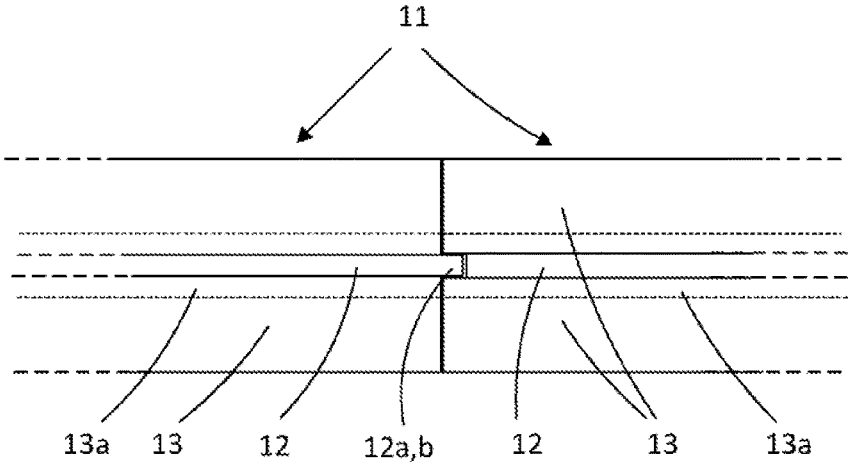
FIG. 1B is a schematic top view of the two basic wall-building elements from FIG. 1A as assembled.

As illustrated by FIG. 1B, the elements may be assembled in accordance with s tongue and groove principle in the lateral direction, due also to the inherent rigidity and dimension stability of the thermal insulation layer.

Figure 2:
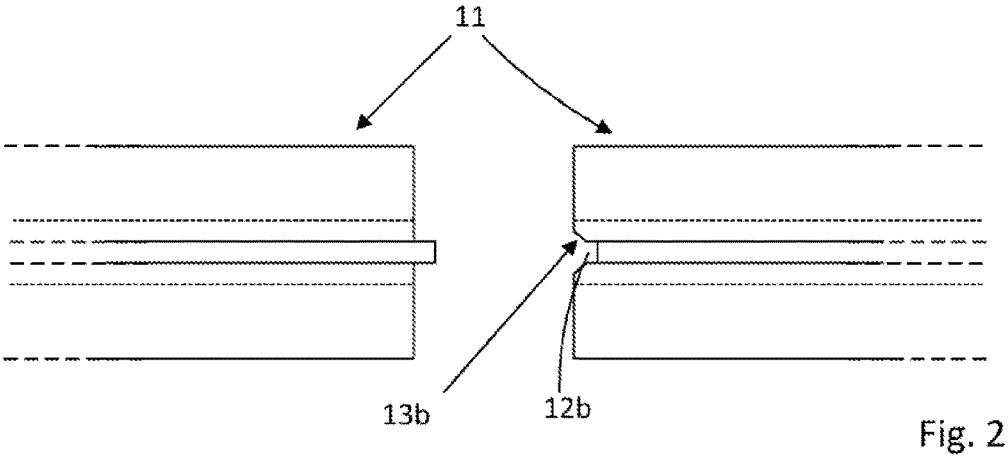
FIG. 2 is a schematic top view of two basic wall-building elements according to an embodiment different from the one shown in FIGS. 1A and 1B, in a state not yet assembled.

FIG. 2 shows schematically a top view of an embodiment of the wall-building element according to an embodiment which is rather similar to the one shown in FIGS. 1A and 1B, the sole difference being that the thermal insulation layer 13 at both sides of the groove 12*b*, is tapered 13*b* to allow easy assembly of the wall-building elements.

Figure 3A:
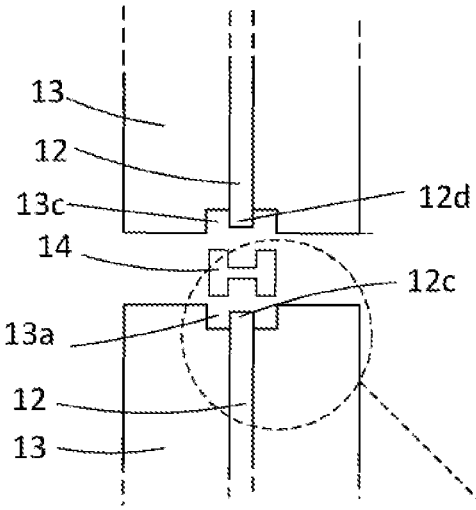
FIG. 3A is a schematic side short end view of two basic wall-building elements according, one above the other, not assembled.

FIG. 3A shows schematically a side view of parts of two wall-building elements in accordance with an embodiment, similar with or equal to the one shown in FIGS. 1A and 1B. The view is from the short end of each element, which is with the largest horizontal extension of the elements perpendicular to the paper plane.

At both sides of the top edge of the core member 12 and adjacent thereto, the thermal insulation layer 13 exhibits recessed regions 13*a*. In these recessed regions 13*a*, the thermal insulation layer is recessed as compared to the level of the insulation layer farther away from the core member 12 and it is recessed also when compared with the core member 12.

A similar recessed region 13*c* is shown at the bottom of the upper element. FIG. 3A also illustrates the fact that the load bearing core member 12 extends vertically above the recessed region 13*a* but not quite to the top level of the thermal insulation layer 13.

An H-shaped beam 14 is used to connect the upper wall building element to the one below.

Figure 3B:
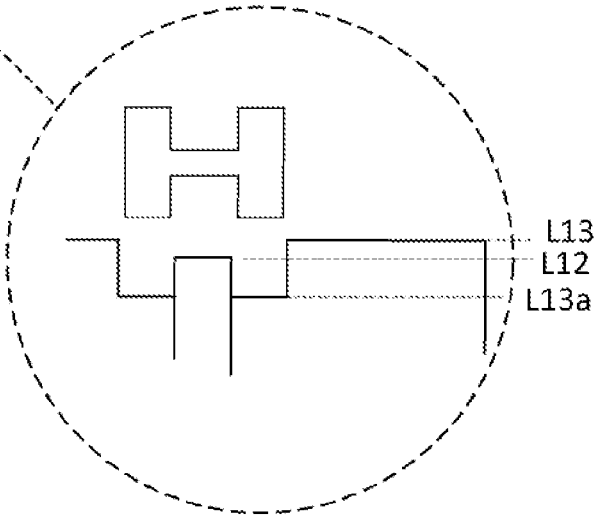
FIG. 3B is an enlargement of a part of FIG. 3A.

FIG. 3B is an enlargement of details encircled in FIG. 3A. The level differences mentioned above are seen more clearly in FIG. 3B. The three levels at the top of the wall-building elements are shown namely the top level L13 of the thermal insulation layer, the top level L12 of the load bearing core member 12 and the level L13*a* of the recessed region 13*a* of the thermal insulation layer 13. It is understood that the horizontal part of the H shaped beam 14 has a width or thickness that is about twice the level difference between levels L13 and L12 while the vertical extension of the H shaped beam is about twice the difference between the levels L13 and L13*a*.

Similarly, at the bottom of each wall-building element 11, the load bearing core member 12 extends below the recessed region 13*c* of the thermal insulation layer 13 but not quite to the lowermost level of the thermal insulation layer.

The wall-building element system according to one aspect comprises two additional components one being an H-shaped beam or rail 14 adapted to fit between different vertical layers of wall-building elements 11. The dimension of the H-shaped beam are adapted to the dimensions of the recessed regions 13*a*, 13*c*, and to the level difference between the top of the load bearing core member 12 and the top level of the thermal insulation layer 13.

Figure 3C:
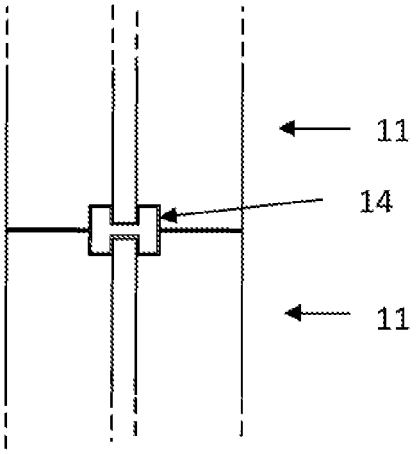
FIG. 3C is a schematic side end view of the elements shown in FIG. 3A, assembled.

FIG. 3C is a side view of the elements shown in FIG. 3A in assembled position, using the H-beam 14 as a stabilizing and load-transferring member between the layers. The H beam may be made in any strong, stable material. Typically, the H shaped beam 14 is made of light metal, composite materials or compact plastic material, with a density and compressive strength much higher than the thermal insulation layer and at least comparable with the density and compressive strength of the core member 12. The length of each H beam 14 may be different from the horizontal extension of the wall-building elements and the joints between the different H beam elements are typically positioned so as not to coincide with the joints between the wall-building elements. While the thermal insulation layer has an integrity and dimension stability in itself, the presence of the H shaped beams between each layer of wall-building elements still significantly enhances the stability of the complete, assembled building structure.

Figure 4A:
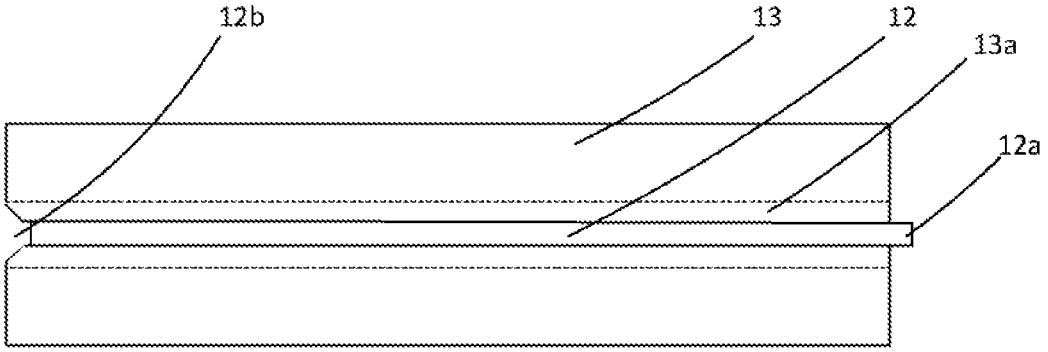
FIG. 4A is a schematic top view of an entire basic wall-building element as shown in FIG. 2.

FIG. 4A shows a top view of an entire wall-building element similar to the ones shown in part in FIG. 2.

Figure 4B:
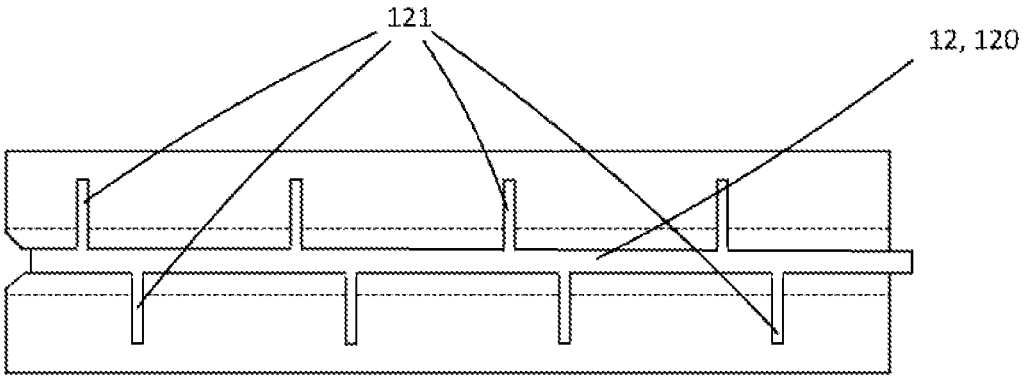
FIG. 4B is a schematic top view of a preferred embodiment of a basic wall-building element.

FIG. 4B shows schematically a top view of a preferred embodiment of a disclosed wall-building element. The difference from the embodiment shown in FIG. 4A is that the core member 12 exhibits lateral ribs 121 extending from both sides of the plate shaped main body 120 of the core member 12. The main body 120 and the ribs are typically casted as a single integrated structure and the vertical extension thereof is typically the same as the main body 120 with the exception that in the recessed region 13*c* of the thermal insulation, the vertical level of the ribs 121 typically coincide with the vertical level L13*a* of the thermal insulation layer 13 in the recessed region. Thereby the ribs 121 are allowed to support the beams 14 directly from underneath.

Figure 4C:
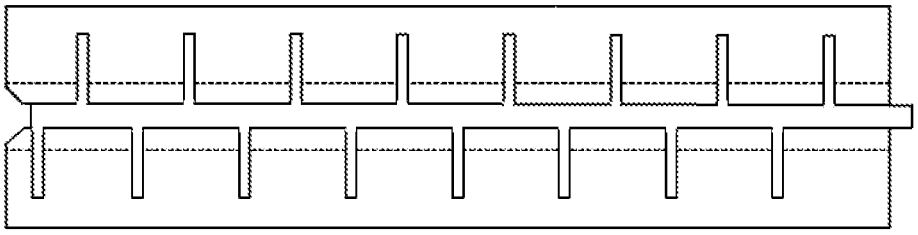
FIG. 4C is a schematic top view of another preferred embodiment of a basic wall-building element.

FIG. 4C shows schematically a slightly different variant of the wall-building element compared to the one shown in FIG. 4B, the only difference being an increased number of ribs 121 extending from the main body 120 of the core member.

Figure 4D:
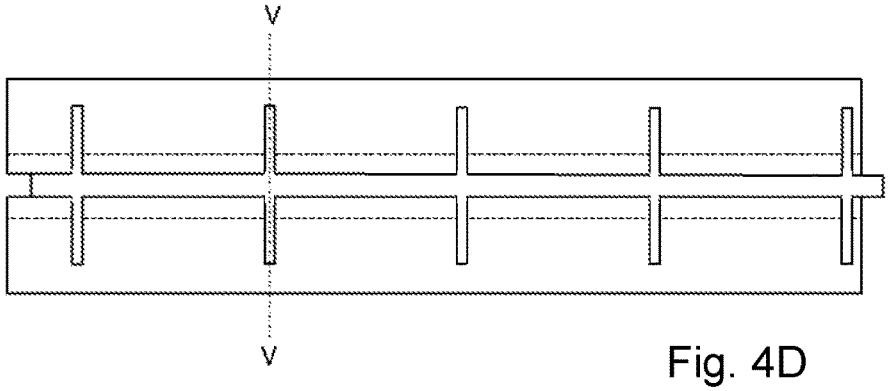
FIG. 4D is a schematic top view of yet another preferred embodiment of a basic wall-building element.

FIG. 4D shows yet another variant in which the ribs are arranged symmetrically on both sides of the main body 120 of the core member.

The ribs shown in FIGS. 4B and 4C have several functions. They serve to make the core members 12 more rigid and twist-resistant, they serve to support and stabilize the thermal insulation layer and, in interaction with the H-shaped beams 14, they serve to distribute the forces transferred between the vertical layers of the structure over a larger area. In addition, as elaborated below, they serve to stabilize the different vertical layers of an assembled wall structure even with regard to lateral forces.

Preferably, the ribs 121 are arranged in a fixed pattern, equally spaced and all ribs arranged in parallel with one another. The longitudinal direction is typically vertical and perpendicular to the main body 120 of the core member 12. The lateral extension is typically a little less than the thickness of the thermal insulation layer 13, thereby allowing the thermal insulation layer to fully cover the ribs and at the same time allowing the thermal insulation layer to be applied as one continuous element rather than a number of smaller elements separated by ribs.

Figure 5A:
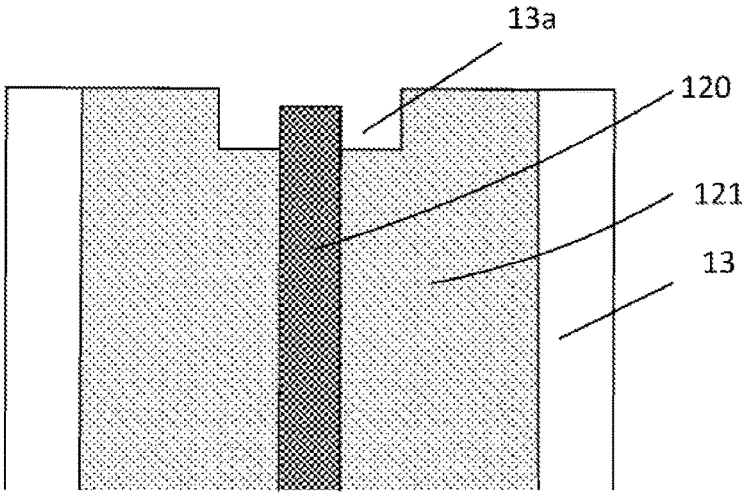
FIG. 5A is a side sectional view of the basic wall-building element shown in FIG. 4D.

FIG. 5A is a side sectional view along the line V-V in FIG. 4D, and generally illustrates the extension of the ribs 121 in relation to or comparison with the thermal insulation layer 13. In the recessed region 13*a*, it I essential that the ribs allow room for the H-shaped beam 14 and therefore exhibit flat areas corresponding to (at least) the width of the recessed region 13*a* of the thermal insulation layer 13. By following the upwards 90 degrees angle of the thermal insulation layer 13 at the imaginary line along the outermost side of the recessed region 13*a*, the ribs provide support for the H-beam even laterally, thereby contributing to the stability of the assembled structure also with regard to lateral forces between the vertical layers thereof.

Figure 5B:
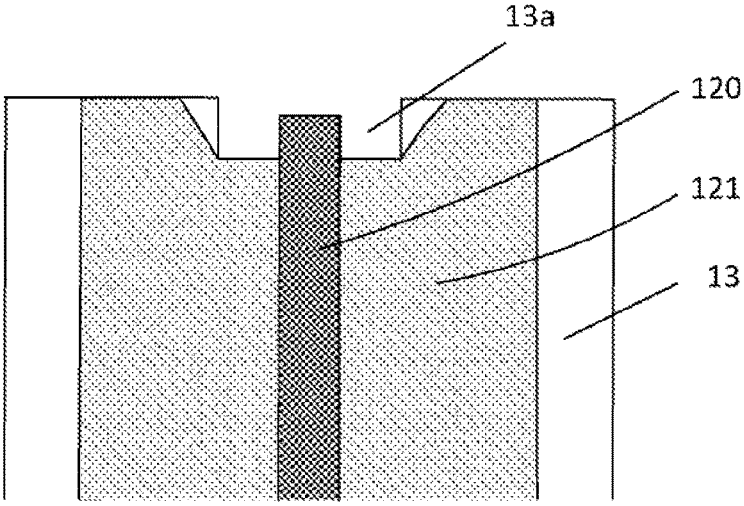
FIG. 5B is a side sectional view of a variant of the basic wall-building element shown in FIG. 4D.

FIG. 5B shows a slightly different variant from the one shown in FIG. 5A, the difference being that the upwards angle of the ribs 121 at the bending line along the outer side of the recessed region 13*a*, is somewhat larger than 90 degrees, making it slightly easier to fit the H-beam into the recessed region 13*a* while still providing lateral support.

While the profiles of the ribs 121 shown in FIGS. 5A and 5B are based on FIG. 4D, the ribs indicated in FIGS. 4B and 4C will typically have similar profiles, contributing to the stabilization of the complete structure when assembled with H-shaped beams 14 between each vertical layer of the wall structure.

Figure 6A:
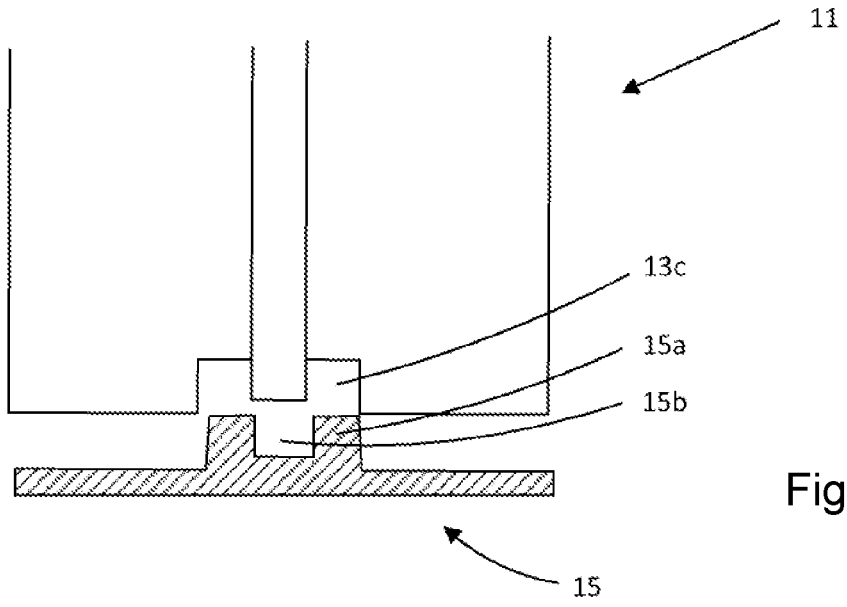
FIG. 6A is a schematic side end view of a basic wall-building element and a sole element.

Reference is now made to FIG. 6A. Beneath the lowermost vertical row of wall-building element 11, a particular sole element 15 is used, the top of which being provided with a profile adapted to the bottom surface of the wall-building elements. The upper surface of the sole element 15 thus exhibits extending flanges 15*a*, which fits into the recessed region 13*c* of wall-building element with a groove 15*b* there-between to allow space for the lower end of the core member, or more specifically, the main body thereof. The width of the sole element is adapted to the width of the wall-building elements, i.e. the sole element is typically as wide as—or somewhat wider than—the wall-building elements.

Figure 6B:
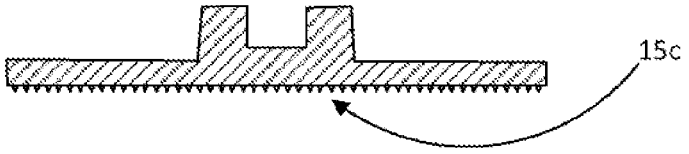
FIG. 6B is a schematic side end view of a slightly different sole element.
Figure 6C:
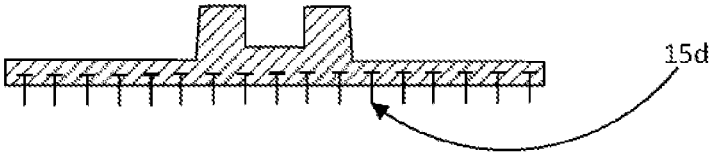
FIG. 6C is a schematic side end view of a yet a variant of the sole element.

FIG. 6B shows a variant of the sole element 15, the difference being that the lower surface is corrugated to slightly penetrate the ground on which it is placed. FIG. 6C shows yet a variant where the lower surface is provided with long spikes to more deeply penetrate the ground.

Figure 7:
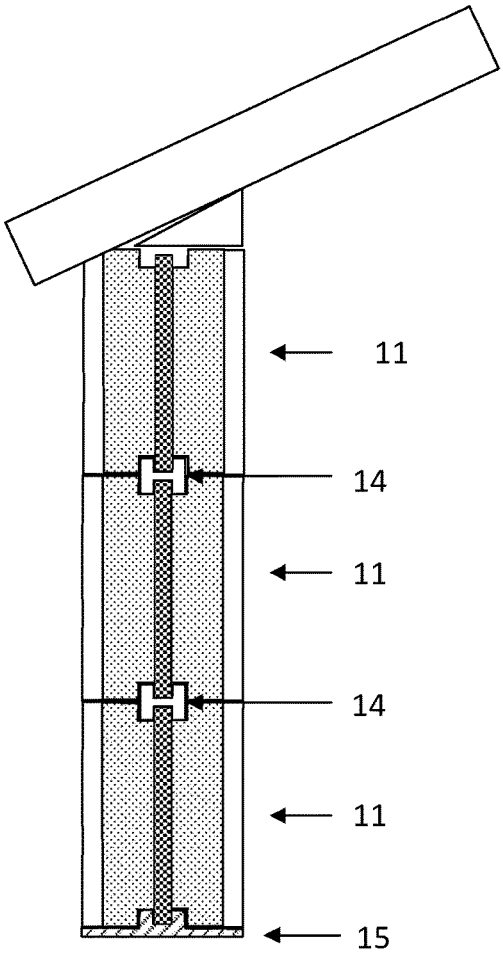
FIG. 7 is a schematic side end view of an assembled wall structure according to an embodiment.

FIG. 7 shows a view an assembled wall structure as seen from the short end of the wall-building elements. The wall structure consists of a bottom sole element 15 and three layers of wall-building elements 11 joined via H-shaped beams 14. FIG. 7 illustrates the fact that the ribs (shaded area) surrounds the H-beams from below and from above, thereby stabilizing the wall structure laterally while transferring the weight load via the H-beams vertically.

FIG. 7 also indicates the presence of a roof for context. The number of floors are not indicated in FIG. 7. The height covered by the three elements on top of one another may correspond to one or more floors. When more than one floor is encountered, floor supporting elements (not shown) such as pillars, bars and/or beams (not shown) would typically be present since the wall structure is not designed to support floors.

Figure 8:
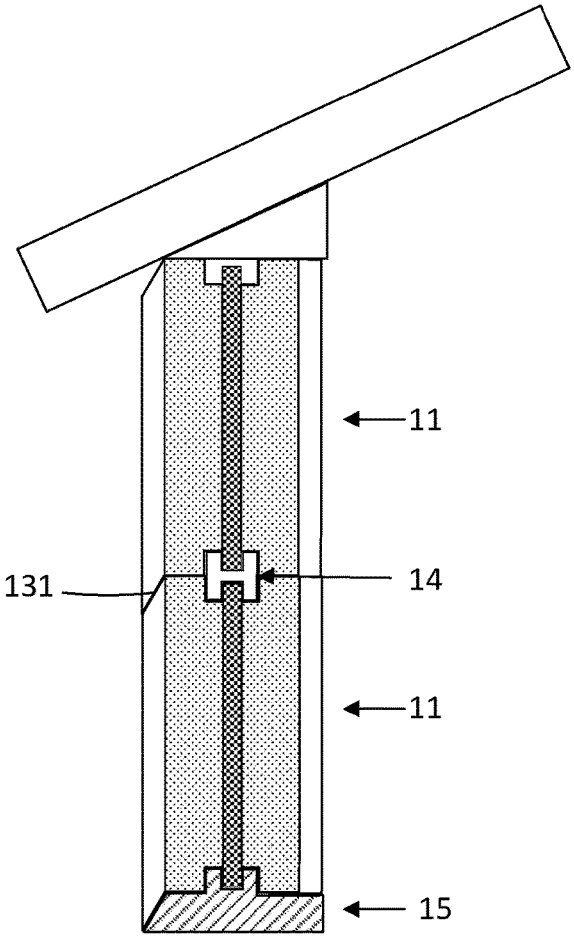
FIG. 8 is a schematic side end view of an assembled wall structure according to another embodiment.

FIG. 8 shows a variation of the wall shown in FIG. 7, the differences being that the wall elements are relatively higher but also that the upper and lower edges of the exterior side of the thermal insulation layer 13 are designed with an inclination 131 preventing water from penetrating the wall during rainfall.

Additional Features and Embodiments

The basic wall-building elements are typically symmetrical around the central load-bearing core, with the possible exception of a particular layer of UV resistant and/or moisture resistant material at its exterior side. In the drawings 1-7, all basic wall-building elements are shown as symmetrical in this respect.

While the exterior and the interior side of the wall-building elements may be identical to one another, there is also the possibility of providing at least one extra layer on the exterior side, to better protect against humidity and/or deterioration by sunlight.

While the wall-building elements are suitable for assembly of complete buildings, with the exception of a roof, the elements may also be used for providing thermal insulation in existing buildings.

For assembly in an already existing building, as a building within a building or as thermal insulation in an existing building, the basic wall-building element may assume a simpler design wherein a thermal insulation layer is provided at only one side of the core member. This allows the assembly of lighter elements which still provides a required degree of thermal insulation but which does not need to exhibit the same level of load bearing capacity, in particular since the inner wall made thereof will not be carrying an outer roof.

The invention claimed is:

1. A wall-building element system comprising:

a plurality of sole elements (15) adapted to be assembled to a sole arranged to support insulated wall-building elements;

a plurality of basic wall-building elements (11) adapted to be assembled horizontally and vertically to a wall; and a plurality of beams (14), each beam being adapted to be fitted horizontally between each stacked basic wall-building element (11), wherein the sole elements (15) and basic wall-building elements (11) have respective widths that are adapted to one another, and each of the sole elements (15) has a top profile that is adapted to a bottom side of a basic wall-building element (11) of the plurality of basic wall-building elements (11), the basic wall-building elements (11) are prefabricated with a central load-bearing core member (12) with a form-stable layer of thermal insulation (13) on each side thereof, each core member (12) having a top (12*c*) and a bottom (12*d*), each thermal insulation layer has a linear recessed region (13*a*) extending along each side of the respective core member's top (12*c*) and a linear recessed region (13*c*) extending along each side of the respective core member's bottom (12*d*), the core member tops each have a top edge that protrudes from its respective recessed level of the thermal insulation layer and the core member bottoms each having a bottom edge that protrudes from its respective recessed level of the thermal insulation layer, the top and bottom edges protruding to a level between the respective recessed level (L13*a*) of the thermal insulation layer and a non-recessed level (L13) of the thermal insulation layer, while along one vertical side of each basic wall-building element, the core member (12) protrudes to form a tongue (12*a*) while along an opposite side of the basic wall-building element, the core member (12) is recessed to constitute a groove (12*b*) adapted to receive the tongue (12*a*) of an adjacent wall-building element, and each of the beams (14) has an H-shaped cross section with a width adapted to the total width of the linear recessed region (13*a*) along both sides of the core member and a height adapted to a combined height of the top recessed region (13*a*) and the bottom recessed region (13*c*) of the wall-building elements (11).

2. The wall-building element system as claimed in claim 1, wherein each of the core members (12) comprises a plate shaped main body (120) provided with laterally extending and vertically oriented ribs (121).

3. The wall-building element system as claimed in claim 2, wherein each of the ribs (121) has an upper edge that coincides with the level (L13*a*) of the recessed region (13*a*).

4. The wall-building element system as claimed in claim 1, wherein each of the ribs (121) has an upward bend along the imaginary lines at the outermost ends of the recessed (13*a*) regions.

5. The wall-building element (11) system as claimed in claim 1, wherein each of the core members (12) comprises a plate shaped main body (120), further comprising ribs (121) extending laterally from both sides of the main body (120) of at least one of the load bearing core members (12).

6. The wall-building element (11) system as claimed in claim 5, further comprising ribs (121) extending laterally from both sides of the main body (120) of each of the load bearing core members (12).

7. The wall-building element (11) system as claimed in claim 1, wherein each of the core members (12) comprises a plate shaped main body (120) that extends vertically from linear recessed areas of the thermal insulation layer (13) on both sides of the respective core member (12).

8. The wall-building element (11) system as claimed in claim 1, wherein the thermal insulation layers (13) are made of foamed recycled plastic material having a density within a range of 25-35 kg/m$^3$.

9. The wall-building element (11) system as claimed in claim 1, wherein the load bearing core members (12) have a density within a range of 80-130 kg/m$^3$ and comprise a material selected from the group consisting of honeycomb polymer structure, composite materials, plywood, or a combination thereof.

10. The wall-building element (11) system as claimed in claim 9, wherein the load bearing core members (12) comprise honeycomb polymer structure formed from recycled polymer material.

11. The wall-building element (11) system as claimed in claim 1, wherein the load bearing core members (12) have a density within a range of 80-130 kg/m$^3$ and comprise a material selected from the group consisting of honeycomb polymer structure, composite materials, plywood, or a combination thereof.

12. The wall-building element (11) system as claimed in claim 1, wherein the upper and lower edges of an exterior side of the thermal insulation layers (13) have an inclination (131) formed therein.

* * * * *